United States Patent [19]

Yoshida

[11] Patent Number: 4,738,052

[45] Date of Patent: Apr. 19, 1988

[54] AUTOMATIC DOOR WITH AUTOMATIC LOCK SYSTEM

[75] Inventor: Yukio Yoshida, Namerikawa, Japan

[73] Assignee: Yoshida Kogyo K. K., Tokyo, Japan

[21] Appl. No.: 28,790

[22] Filed: Mar. 23, 1987

[30] Foreign Application Priority Data

Mar. 26, 1986 [JP] Japan ..... 61-43115[U]

[51] Int. Cl.[4] ..... E05F 15/20

[52] U.S. Cl. ..... 49/31; 49/360

[58] Field of Search ..... 49/31, 141, 360, 347, 49/349, 352

[56] References Cited

U.S. PATENT DOCUMENTS

| | | | |
|---|---|---|---|
| 2,217,852 | 10/1940 | Anderson | 49/31 |
| 2,989,302 | 6/1921 | Clark | 49/360 |
| 4,152,870 | 5/1979 | Knap | 49/360 |
| 4,213,379 | 7/1980 | Cromley | 49/31 |
| 4,330,960 | 5/1982 | Hasemann et al. | 49/360 |
| 4,375,019 | 2/1983 | Yoshida | 49/31 |

FOREIGN PATENT DOCUMENTS

| | | | |
|---|---|---|---|
| 76043 | 6/1975 | Australia | 49/360 |
| 60-16552 | 4/1985 | Japan . | |

*Primary Examiner*—Peter A. Aschenbrenner
*Assistant Examiner*—Gerald A. Anderson
*Attorney, Agent, or Firm*—Hill, Van Santen, Steadman & Simpson

[57] ABSTRACT

An automatic door including a door body connected to a chain or belt extending between and wound around a drive pulley disposed on one side of a door opening and a driven pulley disposed on the other side thereof in which the door body is actuated to open and close by allowing the drive pulley to be rotated forwardly or reversely by an electric motor connected through a main switch and a controller to a main electric power supply source, comprises an apparatus for automatically moving the door body to its closing-stop point when the supply of electric power to the motor is interrupted by the OFF operation of the main switch, and a locking apparatus for automatically locking the door body in its closing-stop position at that time.

8 Claims, 2 Drawing Sheets

AUTOMATIC DOOR WITH AUTOMATIC LOCK SYSTEM

BACKGROUND OF THE INVENTION

This invention relates to an automatic door adapted to be driven to open and close by means of an electric motor, and more particularly to an automatic door in which the door body can be automatically closed and locked at the closing-stop point thereof when the supply of electric power to the electric motor is interrupted.

Automatic doors comprise generally a belt extending around a drive pulley located on one side of a door opening and adapted to be driven by a motor and a driven pulley located on the other side of the door opening, the belt being connected to the door body, and the automatic doors are arranged such that the door body can be moved to its opening- or closing-stop point by allowing the drive pulley to be rotated forwardly or reversely. Therefore, when the main electric power supply for supplying power to the motor is broken, the motor is stopped thereby stopping the door body immediately at the position as it is. As a result, the automatic door remains open.

Heretofore, as to the apparatus for moving automatic doors to their opening- and closing-stop points in case of emergency, there has been known an emergency door opening and closing apparatus utilizing a weight. In such an apparatus, there is a fear that, when the door body is opened or closed in case of emergency, the stopper having a chain or rope connected to a weight may move quickly towards and collide against the stopper device provided on the door causing a high impact force and a shock sound giving a damage to the apparatus.

Further, the Japanese Patent Publication No. SHO 60-16552 discloses an apparatus for automatically moving a door body in the direction of opening closing-stop point thereof by the resilient force of a plate spring when the main power supply is switched off so as to move the automatic door to its opening- or closing-stop point. However, in both the apparatus mentioned earlier and the apparatus disclosed in the above Japanese Patent publication, the automatic door cannot be automatically locked at its closing-stop point. For example, even if the main power supply installed in an office building is switched off when leaving the office, each of the locking apparatuses installed on all doors need to be locked manually, which is very troublesome operation.

SUMMARY OF THE INVENTION

The present invention has been contemplated in view of the above-mentioned circumstances in the prior art, and has for its aim to provide an automatic door having an apparatus for automatically moving a door body to its closing-stop point when the supply of electric power to the motor is interrupted, and a locking apparatus for automatically locking the door body at its closing-stop point.

In order to achieve this aim, according to the present invention, there is provided an automatic door which includes a door body connected to a chain or belt means extending between and wound around at least one drive pulley disposed on one side of a door opening and at least one driven pulley disposed on the other side thereof, the arrangement being made such that the door body is actuated to open or close by allowing the drive pulley to be rotated forwardly or reversely by means of an electric motor connected through a main switch and a controller to a main electric power supply source, characterized in that it further includes an apparatus for automatically moving the door body to its closing-stop point when the supply of electric power to the motor is interrupted by the OFF operation of the main switch, and at least one locking apparatus for automatically locking the door body in its closing-stop point at that time.

Further, according to the present invention, there is provided an automatic door, characterized in that the apparatus for moving the door body to its closing-stop point includes a battery; an alternating current relay adapted to be turned on or off when the main switch is turned on or off, respectively; an electric motor for driving the door to open or close; a controller for use with the motor, and a contact connected in the circuit between the battery and the controller, the contact being adapted to be turned on when the alternating current relay is turned off.

Still further, according to the present invention, there is provided an automatic door, characterized in that the locking apparatus comprises a lock receiver mounted on the door body, and a lock body mounted on the framework of the door and adapted to be located opposite to the lock receiver when the door body is located at its closing-stop point, the arrangement being made such that the lock body is normally held at its unlocked position spaced away from the lock receiver, whilst the lock body is moved to its locked position where the lock body is engaged with the lock receiver, when the supply of power to the electric motor for driving the door to open or close is interrupted.

The above and many other advantages, features and additional objects of the present invention will become apparent to those versed in the art upon making reference to the following detailed description and accompanying drawings in which preferred structural embodiments incorporating the principles of the present invention are shown by way of illustrative sample.

DETAILED DESCRIPTION OF THE INVENTION

Figure 1:
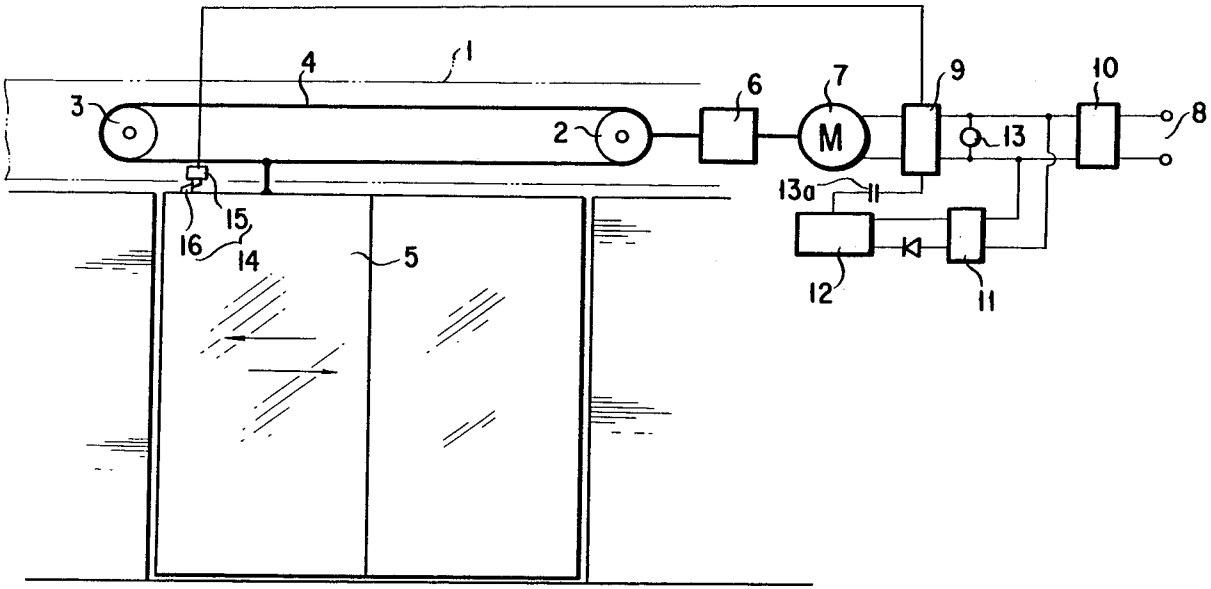
FIG. 1 is a schematic, overall explanatory view of one embodiment of the automatic door according to the present invention.

Referring first to FIG. 1, one embodiment of the automatic door according to the present invention will be described.

A horizontal member 1 such as, for example, a transom forming the framework of the door has a pulley 2 adapted to drive the door body 5 so as to open and close it, and a driven pulley 3 which are disposed on one side and the other side of a door opening, respectively. A belt 4 extending between and wound around the pulleys 2 and 3 is connected to the door body 5, and the drive pulley 2 is connected through a reduction gear 6 to an electric motor 7. The electric motor 7 is connected through a controller 9 with a main power supply 8. The arrangement is made such that when a main switch 10 is switched on, the power from the main power supply 8 is supplied through the controller 9 to the motor 7. Stating specifically, the controller 9 is arranged to control the power to be supplied to the motor 7 so as to open and close the door body 5 according to the usual opening and closing actuation sequence.

A battery 12 is connected through a charging circuit 11 with the above-mentioned main power supply 8, and an alternating current relay 13 is connected with the input side of the controller 9. A contact 13*a* of the relay 13 is connected between the battery 12 and the controller 9. When the a.c. relay 13 is turned off, the contact 13 is turned on so as to supply the power from the battery 12 to the controller 9 to thereby rotate the motor 7 reversely so as to move the door body 5 towards its closing-stop point. The above-mentioned transom 1 and door body 5 have a lock body 15 and a lock receiver 16 mounted thereon, respectively. The lock body 15 and the lock receiver 16 constitutes a locking apparatus 14 and are adapted to be engaged with each other when the door body 5 is kept at its closing-stop point.

Figure 2:
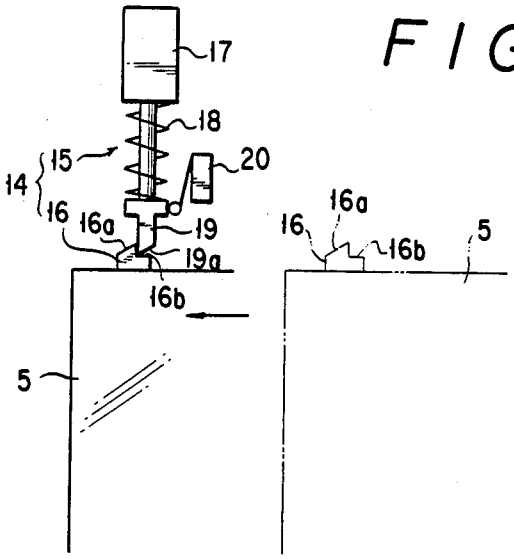
FIG. 2 is a schematic explanatory view of locking apparatus for use in the embodiment shown in FIG. 1.

As shown in FIG. 2, the above-mentioned lock body 15 comprises a latch 19 adapted to be held at its unlocked position, for example, its upper position by means of a solenoid 17 when the latter is actuated, and to be moved to its locked position for example, its lower position by the resilient force of a compression spring 18, and a limit switch 20 adapted to be turned on when the latch 19 has been moved to its lower position. The limit switch 20 is connected with the aforementioned battery 12 so that the locked condition may be confirmed by means of an lamp adapted to be illuminated under the locked condition etc. The solenoid 17 is adapted to be energized so as to move the latch 19 to its upper position against the biasing force of the spring 18 when the solenoid 17 is connected through the controller 9 with the main power supply 8 and the latter is switched on. The aforementioned dog 16 has an inclined surface 16*a* formed thereon adapted to be located opposite to an inclined surface 19*a* formed on the latch 19.

Thus, when the main switch 10 is switched off to interrupt the supply of power from the main power supply 8, the supply of power to the motor is suspended to stop the door body 5 at that position, and also the solenoid 17 is deenergized to allow the latch 19 to be urged to its lower position by the force of the compression spring 18. Whilst, when the main switch 10 is turned off, the a.c. relay 13 is turned off also. As a result, the electric power from the battery 12 is supplied to the controller 9 so as to rotate the motor 7 reversely by the operation of the controller 9 thereby moving the door body 15 in the direction of its closing-stop point. Thus, the inclined surface 16*a* on the lock body 15 will engage with the inclined surface 19*a* on the latch 19 to thereby push up the latch 19 by its wedge action. At the closed position, the latch 19 will be lowered by the force of the compression spring 18 and engaged with the lock receiver 16 thereby locking the door body 5 at its closing-stop point. Further, the latch 19 is arranged to abut against an upwardly facing step 16*b* so as to prevent the latch from moving down further.

Further, when the main switch 10 is switched on to effect usual opening and closing of the door, the solenoid 17 is energized to allow the latch 19 to be held at its upper position, and therefore even if the door body 5 is moved to its closing-stop point the latch 19 is not engaged with the lock receiver 16, and also the battery 12 is charged by the charging circuit 11.

Further, the arrangement can be made such that, when the main power supply 8 is broken by a fine etc. while the main switch 10 is rendered on, the motor 7 is, rotated forwardly by the power supplied by the battery 12 through the controller 9 so as to open the door body 5.

While, in the above-mentioned embodiment, the battery 12 is connected through the controller 9 and the contact 13*a* with the motor 7, the contact 13*a* may be directly connected with the motor 7.

Figure 3:
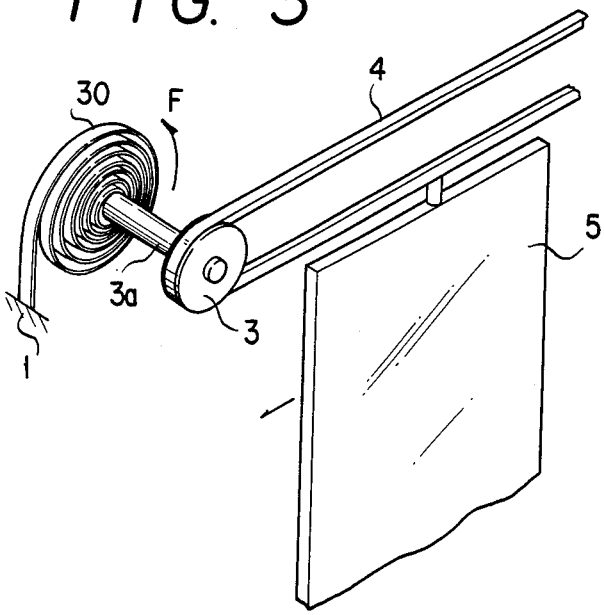
FIG. 3 is a schematic explanatory view of another embodiment of the apparatus for moving the door body to its closing-stop point during suspension of electric power supply.

Further, in the above-mentioned embodiment, the arrangement is made such that when the main switch 10 is switched off the door body 5 is moved to its closing-stop point by the electrical device including the battery 12, however, it is needless to say that the same function can be achieved by a mechanical means in place of the electrical device. As an example of the mechanical means, as shown in FIG. 3, it can be considered to reversely rotate the driven pulley 3 by rewinding force F provided by a coiled spring 30. Several other mechanisms than the aforementioned ones can be envisaged which are adapted to move the door body 5 to its closing-stop point when the supply of power to the motor 7 is interrupted.

It is to be understood that the foregoing description is merely illustrative of the preferred embodiments of the present invention and that the scope of the invention is not to be limited thereto. Additional modifications or alternations of the invention will readily occur to those skilled in the art without departing from the scope of the invention.

What is claimed is:

1. An automatic door which includes a door body connected to a chain or belt means extending between and wound around at least one drive pulley disposed on one side of a door opening and at least one driven pulley disposed on the other side thereof, wherein the door body is actuated to open or close by allowing the drive pulley to be rotated forwardly or reversely by means of an electric motor connected through a main switch and a controller to a main electric power supply source, characterized in that the automatic door further includes a means for automatically moving the door body to its closing-stop point when the supply of electric power to the motor is interrupted by the OFF operation of the main switch, and at least one locking means for automatically locking the door body in its closing-stop point at that time.

2. The automatic door as claimed in claim 1, characterized in that said apparatus for moving the door body to its closing-stop point includes a battery; an alternating current relay adapted to be turned on or off when the main switch is switched on or off, respectively; an electric motor for driving the door to open or close; a controller for use with the motor; and a contact connected between the battery and the controller, the contact being adapted to be turned on when said alternating current relay is turned off.

3. The automatic door as claimed in claim 2, characterized in that said contact is provided in a circuit connected directly between the motor and the battery.

4. The automatic door as claimed in claim 1, characterized in that said locking apparatus comprises a lock receiver mounted on the door body, and a lock body mounted on the framework of the door and adapted to be located opposite to the lock receiver when the door body is located at its closing-stop point, the arrangement being made such that the lock body is normally held at its unlocked position spaced away from said lock receiver, whilst the lock body is moved to its locked position where the lock body is engaged with the lock receiver, when the supply of power from the main power supply to the electric motor for driving the door to open or close is interrupted.

5. The automatic door as claimed in claim 4, characterized in that said lock body comprises a latch having an inclined surface formed in the leading end thereof and adapted to be moved freely in the vertical direction; a solenoid means connected through said controller with said power supply and adapted to be energized so as to hold the latch at its upper position or unlocked position when the main power supply is switched on; and a compression spring for moving said latch to its lower position or locked position when the supply of power from the main power supply is interrupted.

6. The automatic door as claimed in claim 4, characterized in that said lock receiver is a dog having an inclined surface adapted to be located opposite to the inclined surface formed in the leading end of said latch.

7. The automatic door as claimed in claim 2, characterized in that in case of emergency such as fire etc., when the supply of power from the main power supply is stopped while the main switch is kept on, said controller is actuated to rotate said motor forwardly by the power supplied from said battery thereby opening the door body.

8. The automatic door as claimed in claim 1, characterized in that said apparatus for moving the door body to its shut position includes a coiled spring wound round the shaft of said driven pulley, and when the supply of power from the main power supply is stopped, the driven pulley is rotated reversely by the rewinding force of the coiled spring so as to move the door body to its shut position.

* * * * *